US005683138A

United States Patent [19]

Ward, Jr. et al.

[11] Patent Number: 5,683,138

[45] Date of Patent: Nov. 4, 1997

[54] ADJUSTABLE SHIELD FOR INFANT CAR SEAT SAFETY BELTS

[75] Inventors: William T. Ward, Jr., Uniontown; MaryAnn Celestina-Krevh, Euclid; Michael P. Green, Youngstown, all of Ohio

[73] Assignee: Century Products Company, Macedonia, Ohio

[21] Appl. No.: 691,809

[22] Filed: Jul. 31, 1996

[51] Int. Cl.[6] ..... A44B 11/25

[52] U.S. Cl. ..... 297/256.15; 24/685 B; 297/484

[58] Field of Search ..... 297/484, 467, 297/256.15, 411.36; 24/633, 68 E, 68 SB

[56] References Cited

U.S. PATENT DOCUMENTS

| | | | |
|---|---|---|---|
| 4,342,483 | 8/1982 | Takada | 297/467 X |
| 4,682,390 | 7/1987 | Parrish | 297/484 X |
| 4,762,369 | 8/1988 | Nicrod | 297/484 |
| 5,324,096 | 6/1994 | Schultz | 297/411.36 |
| 5,435,626 | 7/1995 | Lai | 297/411.36 |
| 5,549,356 | 8/1996 | Gray | 297/484 X |

*Primary Examiner*—Peter M. Cuomo
*Assistant Examiner*—Stephen Vu
*Attorney, Agent, or Firm*—Graham & James LLP

[57] ABSTRACT

A car seat safety belt system used with a car seat for an infant or toddler has an adjustable shield for permitting adjustable placement of the shield relative to a buckle tongue secured to the seat belts. The ends of the upper seat belts attached to the tongue are captured in a buckle tongue housing having an elongated aperture on the outer surface. Mounted within the aperture is an adjustment mechanism having a button portion and a pair of oppositely extending tab portions engageable with individual pairs of a plurality of stop channels arranged along the direction of the elongated aperture. The tongue buckle housing assembly is movably received within a second housing having openings at opposite ends for the buckle tongue and the seat belts, as well as an opening in the outer surface in which the button portion is engaged. A cover member is molded about the second housing, the cover member having openings for accommodating the buckle tongue and the seat belts, as well as an opening for the button portion. The position of the shield relative to the buckle tongue and belts is adjusted by depressing the button portion and sliding the second housing and cover along the long axis of the first housing.

5 Claims, 2 Drawing Sheets

ADJUSTABLE SHIELD FOR INFANT CAR SEAT SAFETY BELTS

BACKGROUND OF THE INVENTION

This invention relates to infant car seats provided with safety belts. More particularly, this invention relates to shields for the belt tongue found in such devices.

Infant car seats are known which include safety belts used to secure an infant in the seat. In a typical arrangement, a pair of belts fastened to an appropriate upper portion of the infant seat are connected together at one end to a tongue. The tongue mates with a buckle which is attached to another belt, which in turn, is secured to a lower portion of the seat. Since the legs of the infant straddle the buckle belt, the tongue and the adjacent portion of the pair of upper belts typically ride on the front of the infant at some position along the chest and abdomen. In order to provide comfort to the infant, a shield is typically installed about the tongue/belt region, with the shield being formed of a soft plastic material so as to eliminate sharp pressure points on the infant's body.

As an infant grows into the toddler stage, the position of the shield, which is fixed with respect to the belts in prior art arrangements, will vary with respect to the body of the infant/toddler. This is, at best, inconvenient, and, at worst, a source of irritation to the infant/toddler riding in the seat.

SUMMARY OF THE INVENTION

The invention comprises an adjustable shield whose position can be varied with respect to the tongue and belt without affecting the length of the tongue/belt combination.

The adjustable shield includes a first housing having a first end, a second end, and an upper surface with an elongated aperture, and a buckle tongue secured to the first end of the first housing and protruding therefrom. One or two seat belts are secured to the buckle tongue and exit from the first housing adjacent the second end.

A second housing is arranged about the first housing so that the first housing is moveably received within the second housing. The second housing has a first end with an aperture for accommodating the buckle tongue and a second end with at least one aperture for accommodating the one or two seat belts. The second housing has an upper surface with an aperture overlying a portion of the elongated aperture of the first housing.

An adjustment mechanism is provided for enabling the relative positions of the first and second housings to be changed, the adjustment mechanism including a stop member located in the first housing and releasably engaged with the first housing in a region adjacent the elongated aperture. The stop member further includes a button portion received within the aperture in the second housing and releasably engaged therewith.

A cover member envelopes a major portion of the second housing, the cover member having apertures for accommodating the buckle tongue, the one or two seat belts, and the button portion of the adjustment mechanism.

The adjustment mechanism preferably comprises a compound member having a main body portion terminating at one end thereof in the button portion and having a pair of oppositely disposed tab portions extending therefrom adjacent the button portion. The first housing includes a plurality of stop channels formed therein and spaced along the direction of the elongated aperture, the stop channels being dimensioned to receive the tab portions. A bias means, such as a coil spring, urges the stop member into engagement with the first housing.

The invention enables the position of the shield to be adjusted along the longitudinal axis of the tongue so that the position of the shield with respect to the infant/toddler's body can be adjusted lengthwise of the torso until the most convenient location is found.

For a fuller understanding of the nature and advantages of the invention, reference should be made to the ensuing detailed description, taken in conjunction with the accompanying drawings.

DESCRIPTION OF THE PREFERRED EMBODIMENTS

Figure 1:
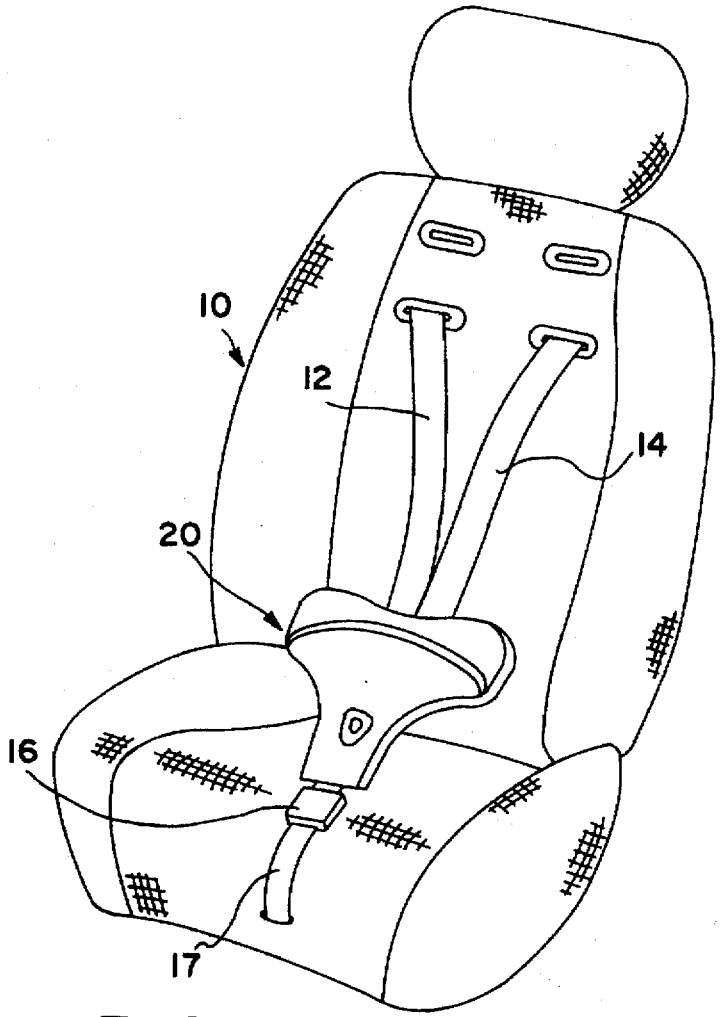
FIG. 1 is a perspective view of an infant car seat incorporating the invention.

Turning now to the drawings, FIG. 1 illustrates an infant's car seat provided with an adjustable shield according to the invention. As seen in this FIG., an infant car seat generally designated with reference numeral 10 has a pair of seat belts 12, 14 attached in a conventional manner to the upper seat portion. Belts 12, 14 are secured to a belt tongue (hidden from view in FIG. 1) and are enclosed about the lower, tongue end thereof by means of an adjustable shield generally designated with reference numeral 20. A conventional tongue buckle 16 releasably secured to the belt tongue in a known manner and buckle 16 is attached to one end of a lower individual belt 17. The opposite end of lower belt 17 is connected in a conventional manner to the lower portion of the car seat 10.

Figure 2:
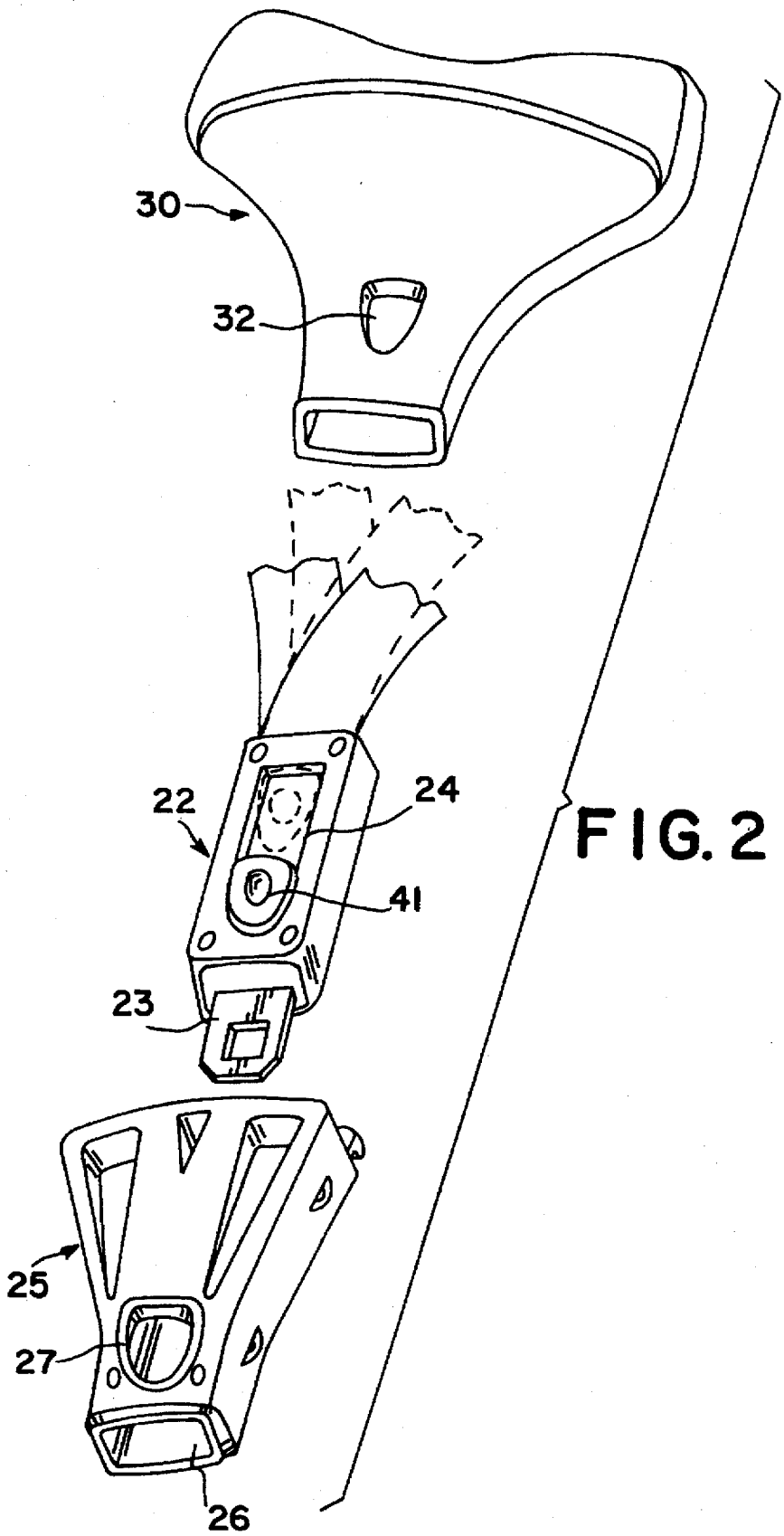
FIG. 2 is an exploded perspective view of the preferred embodiment of the invention.

With reference to FIG. 2, adjustable shield 20 includes a first housing 22 in which a belt tongue 23 is secured at the lower end thereof with the tongue 23 extending therefrom as shown. Although not illustrated in FIG. 2, the adjacent ends of belts 12, 14 are secured to tongue 23 in any suitable fashion. Both tongue 23 and belts 12, 14 are fixed within housing 22. Housing 22 further includes an adjustment aperture 24.

Housing 22 is slidably received within a cover housing generally designated with reference numeral 25 and having a hollow interior with a lower opening 26 therein through which tongue 23 extends externally of housing 25 when housing 22 is positioned within housing 25. Housing 22 may be positioned within housing 25 in any suitable fashion, such as by providing a hollow enclosure within housing 25 contoured to fit about the external surfaces of housing 22.

Shield 20 further includes an outer cover generally designated with reference numeral 30. Cover 30 surrounds housing 25 and a short length of each her 12, 14 extending from the top edge thereof. Cover 30 may be provided with a pair of angularly displaced slots for individually accommodating the tongue ends of separate belts 12, 14. Alternatively, cover 30 may be provided with a single master slot along the upper edge thereof through which the belts 12, 14 extend. Cover 30 is preferably molded about housing 25, after housing 22 has been installed therein. Cover 30 is preferably molded from a soft plastic material, such as polyurethane or the like.

Figure 3:
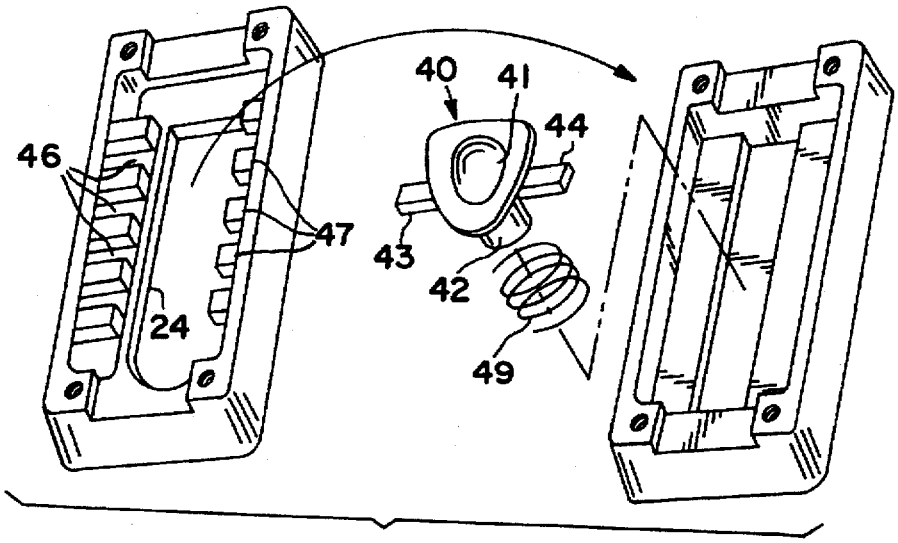
FIG. 3 is a perspective view of the tongue housing and adjustment mechanism with the top half removed and inverted.

As best seen in FIG. 3, tongue housing 22 includes an adjustment mechanism generally designated with reference numeral 40 having an upper button portion 41 which extends upwardly through aperture 24 and is receivable within apertures 27, 32 of housing 25 and cover 30, respectively. Adjustment mechanism 40 includes a main body portion or post 42 extending downwardly therefrom and having a pair of oppositely disposed engagement tabs 43, 44. Tabs 43, 44 are dimensioned to be received within mating stop channels 46, 47 formed in the underside of the upper portion of tongue housing 22. A spring 49 arranged about post 42 rests on the inside bottom surface of tongue housing 22 and provides an upwardly directed biasing force tending to maintain engagement tabs 43, 44 engaged in a respective associated pair of stop channels 46, 47. Adjustment mechanism 40 is thus translatable within recess 24 along the longitudinal axis thereof and has several detent positions along recess 24 afforded by the locations of stop channels 46, 47.

To assemble, belts 12, 14 and tongue 23 are secured within tongue housing 22, along with adjustment mechanism 40. This subassembly is then inserted into housing 25 with the upper button portion 41 extending through aperture 27. Cover 30 is then secured about housing 25, preferably by molding, with the portions of belts 12, 14 extending from tongue housing 22 and housing 25. The molding is done in such a fashion as to form opening 32 in the finished cover 30.

In use, an infant or toddler is placed in the car seat 10, belts 12, 14 are maneuvered over the shoulders of the infant or toddler and tongue 23 is engaged with tongue buckle 16. The relative position of shield 20 with respect to tongue 23 is adjusted by depressing adjustment mechanism 40 and sliding housing 25 and cover 30 as a unit either upwardly or downwardly to the most convenient position on the torso of the infant or toddler. When the adjustment mechanism 40 is released, the spring 49 urges adjustment mechanism 40 in the upper direction so that the flanking tabs 43, 44 engage the stop channels 46, 47, thereby locking housing 25 and cover 30 to housing 22.

As will now be apparent, safety shields fabricated in accordance with the teachings of the invention provide an additional level of comfort to infants and toddlers in a car seat. More particularly, by enabling the position of the shield to be slidably arranged with respect to the tongue, and thus the torso of the infant or toddler, the most convenient and comfortable position for the shield can be easily achieved. The preferred embodiment, the range of adjustment afforded by the invention is about two inches. Other ranges could readily be provided by changing the dimensions of the housings and aperture.

While the above provides a full and complete disclosure of the preferred embodiment of the invention, various modifications and alternate constructions and equivalents will occur to those skilled in the art. For example, while the preferred embodiment has been described and illustrated in the particular T-shaped configuration, other geometrical configurations may be employed, as desired. Therefore, the above description and illustrations should not be construed as limiting the scope of the invention, which is defined by the appended claims.

What is claimed is:

1. An adjustable shield for a car seat safety belt system used with a car seat for an infant/toddler, said shield comprising:

a first housing having a first end, a second end, and an upper surface with an elongated aperture;

a buckle tongue secured to said first end of said first housing and protruding therefrom;

at least one seat belt secured to said buckle tongue and exiting said first housing adjacent said second end;

a second housing arranged about said first housing, said second housing having a first end with an aperture for accommodating said buckle tongue and a second end with at least one aperture for accommodating said at least one seat belt, said second housing having an upper surface with an apeme overlying a portion of said elongated aperture of said first housing, said first housing being moveably arranged within said second housing;

an adjustment mechanism for enabling the relative positions of said first and second housings to be changed, said adjustment mechanism including a stop member located in said first housing and releasably engaged with said first housing in a region adjacent said elongated aperture, said stop member including a button portion received within said aperture in said second housing and releasably engaged therewith.

2. The adjustable shield of claim 1 further including a bias means for urging said stop member into engagement with said first housing.

3. An adjustable shield for a car seat safety belt system used with a car seat for an infant/toddler, said shield comprising:

a first housing having a first end, a second end, and an upper surface with an elongated aperture;

a buckle tongue secured to said first end of said first housing and protruding therefrom;

at least one seat belt secured to said buckle tongue and exiting said first housing-adjacent said second end;

a second housing arranged about said first housing, said second housing having a first end with an aperture for accommodating said buckle tongue and a second end with at least one aperture for accommodating said at least one seat belt, said second housing having an upper surface with an aperture overlying a portion of said elongated aperture of said first housing, said first housing being movably arranged within said second housing;

an adjustment mechanism for enabling the relative positions of said first and second housings to be changed, said adjustment mechanism including a stop member located in said first housing and releasably engaged with said first housing in a region adjacent said elongated aperture, said stop member including a button portion received within said aperture in said second housing and releasably engaged therewith; and a cover member enveloping a major portion of said second housing, said cover member having apertures for accommodating said buckle tongue, said at least one seat belt, and said button portion of said adjustment mechanism.

4. An adjustable shield for a car seat safety belt system used with a car seat for an infant/toddler, said shield comprising:

a first housing having a first end, a second end, and an upper surface with an elongated aperture;

a buckle tongue secured to said first end of said first housing and protruding therefrom;

at least one seat belt secured to said buckle tongue and exiting said first housing adjacent said second end;

a second housing arranged about said first housing, said second housing having a first end with an aperture for accommodating said buckle tongue and a second end with at least one aperture for accommodating said at least one seat belt, said second housing having an upper surface with an aperture overlying a portion of said elongated aperture of said first housing, said first housing being movably arranged within said second housing; and an adjustment mechanism for enabling the relative positions of said first and second housings to be changed, said adjustment mechanism including a stop member located in said first housing and releasably engaged with said first housing in a region adjacent said elongated aperture, said stop member including a button portion received within said aperture in said second housing and releasably engaged therewith, said adjustment mechanism further including a compound member having a main body portion terminating at one end thereof in said button portion and having a pair of oppositely disposed tab portions extending therefrom adjacent said button portion.

5. The adjustable shield of claim 4 wherein said first housing has a plurality of stop channels formed therein and spaced along the direction of said elongated aperture, said stop channels being dimensioned to receive said tab portions.

* * * * *